United States Patent [19]

Hwang Lii

[11] 4,398,752

[45] Aug. 16, 1983

[54] TYPE OF STRUCTURE FOR NEWSPAPER CLIP

[76] Inventor: Chaur-Chiang Hwang Lii, 3rd Floor, No. 1, Alley 49, Lane 82, Hwu Lin St., Taipei City, Taiwan

[21] Appl. No.: 233,121

[22] Filed: Feb. 10, 1981

[51] Int. Cl.[3] ..... B42D 15/06; B42D 17/00

[52] U.S. Cl. ..... 281/47

[58] Field of Search ..... 281/45, 46, 47, 48, 281/49, 50; 40/359, 360; 5/451

[56] References Cited

U.S. PATENT DOCUMENTS

| | | | |
|---|---|---|---|
| 104,122 | 6/1870 | Day | 281/47 |
| 337,366 | 3/1886 | Borden | 281/47 |
| 508,769 | 11/1893 | Schweitzer | 281/47 |
| 646,259 | 3/1900 | Blaisdell | 281/47 |
| 1,439,716 | 12/1922 | Simensen et al. | 281/48 |
| 2,135,013 | 11/1938 | Nitz et al. | 281/47 |
| 2,157,080 | 5/1939 | Mandel | 281/47 |

FOREIGN PATENT DOCUMENTS

| | | | |
|---|---|---|---|
| 166966 | 4/1959 | Norway | 281/47 |
| 164214 | 12/1933 | Switzerland | 281/47 |

*Primary Examiner*—Gil Weidenfeld
*Assistant Examiner*—John S. Brown
*Attorney, Agent, or Firm*—Cushman, Darby & Cushman

[57] ABSTRACT

A newspaper clip structure permitting easy insertion and or removal of any of a plurality of newspapers. It includes a cylindrically shaped bar having a plurality of longitudinal slots. A ring member having a central opening engages one side of the bar and includes a plurality of holes for pivotally retaining a plurality of wires. A collar member including a central opening engages the other end of the bar member and includes a notch adapted to receive and retain the other end of each wire. The wires are shaped such that when released from the collar member notch they may pivot freely away from the bar and when they are retained within the notch they are held securely within their respective grooves of the bar to firmly grasp a newspaper therein. The wires are sufficiently thin so that none of the printed portion of the newspaper is covered when it is held by the newspaper clip.

8 Claims, 4 Drawing Figures

TYPE OF STRUCTURE FOR NEWSPAPER CLIP

BACKGROUND OF THE INVENTION

The conventional newspaper clip utilizes two clip plate members, but this kind of structure has the following disadvantages: 1. Since the width of the clip plate is wider than the blank space between the adjacent leaves of the newspaper, it is inevitable that some printed area of the newspaper will be covered by the clip plate and as a result, it is not possible to completely read the newspaper. If the clip plate were to be made sufficiently narrow so as to not cover any of the printing the newspaper would be held too loosely. This would not be practical. 2. When it is desired to clip additional copies of newspaper, the newspaper already clipped must be first taken out and then put together with the additional copies to be clipped. The new bundle is then clipped. In this respect, the operation of the conventional clip is very inconvenient.

SUMMARY OF THE INVENTION

With the above in mind, there is provided a simple and convenient newspaper clip for overcoming the afore-mentioned disadvantages. Several slots (grooves) are made over the outer rim of a round bar, and a movable free iron wire is inset into one of these slots to clip the newspaper. Two handles, one at each end of the round bar are used to lock and fasten the iron wire. Operation is simple and convenient. It can clip many copies of newspaper and the printed area of the newspaper is not covered by the iron wire so that all the news can be completely read.

DETAILED DESCRIPTION OF PREFERRED EMBODIMENT

Figure 1:
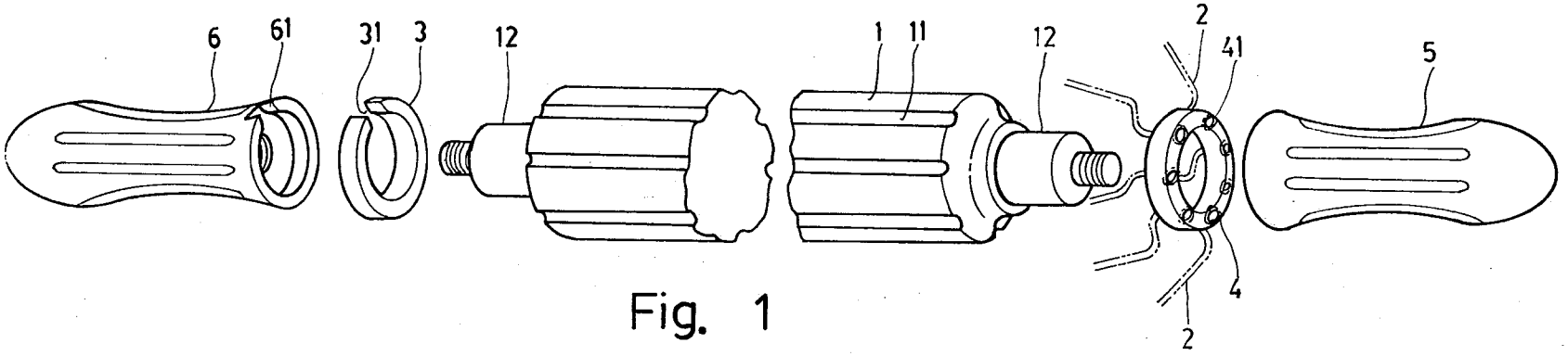
FIG. 1 is an exploded view of the newspaper clip according to the present invention.
Figure 2:
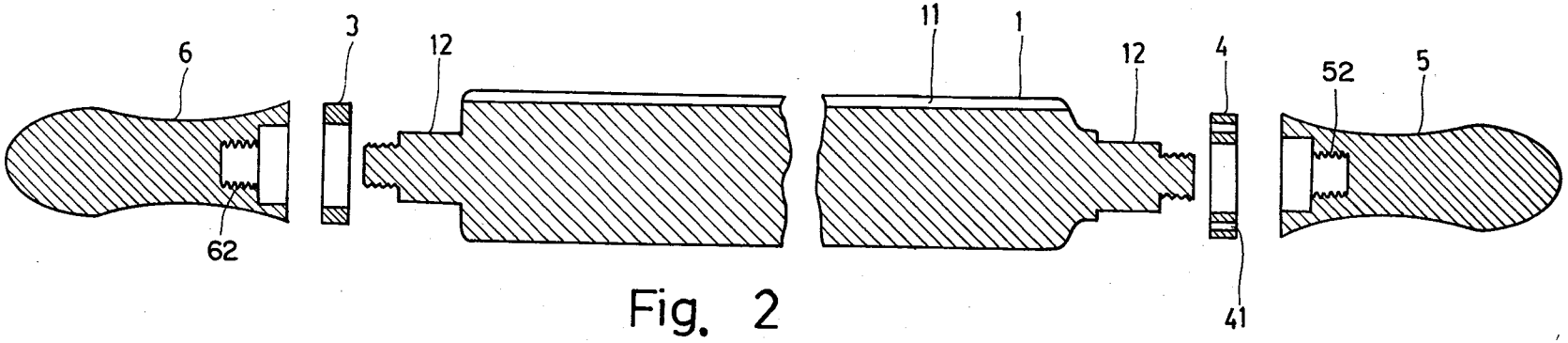
FIG. 2 is a cross sectional view of the newspaper clip.
Figures 3, 4:
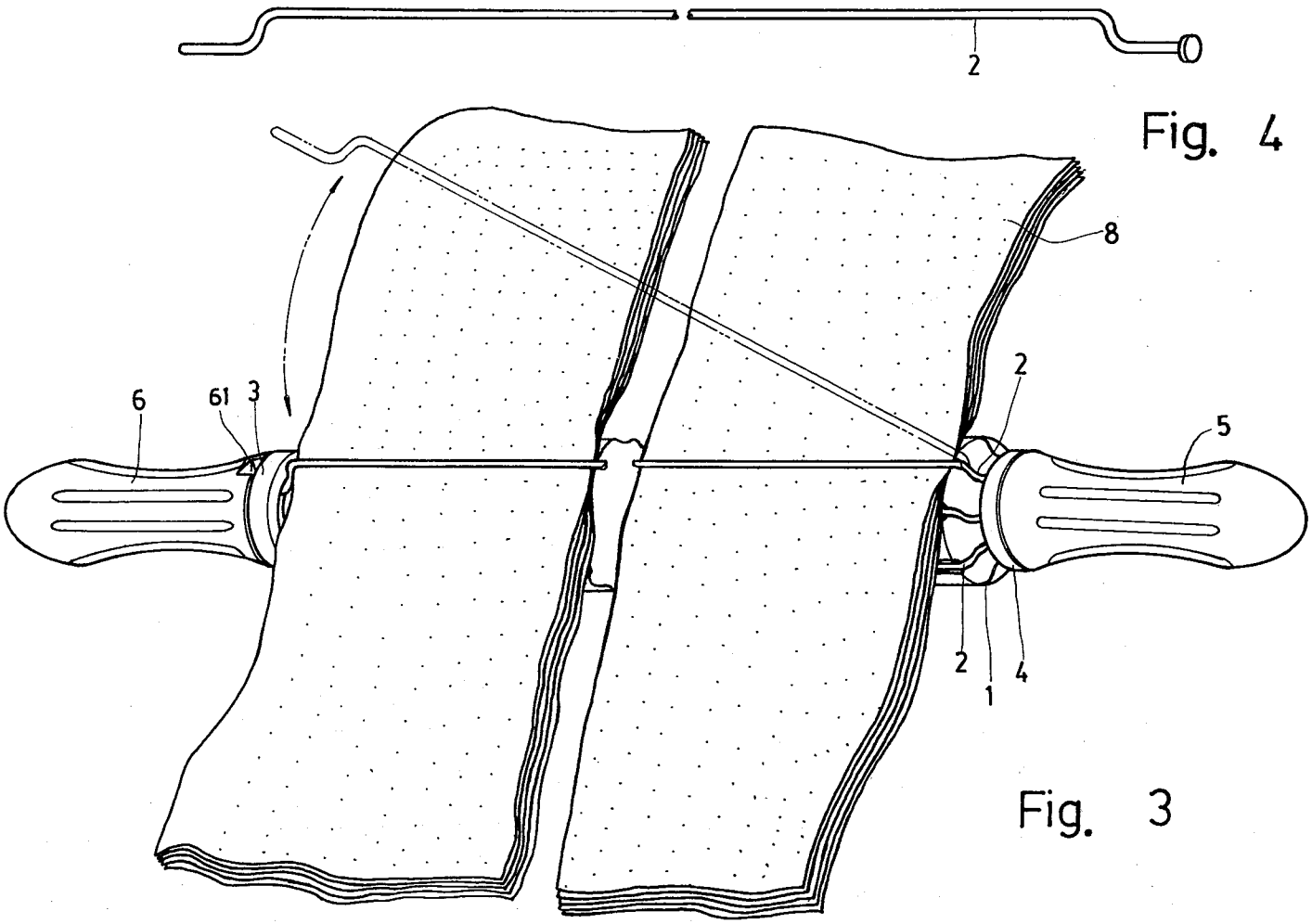
FIG. 3 is a diagram illustrating the operation of the newspaper clip according to the present invention.
FIG. 4 is a diagram of iron wire 2 showing its shape.

The newspaper clip of this invention is mainly composed of a cylindrical bar(1), a plurality of iron wires(2), a collar(3), a ring(4) and handles(5) and (6). A plurality of longitudinal slots or grooves(11) are formed in the outer rim of the bar(1) adapted to receive iron wires(2). At each of the ends of bar(1) there are formed thread bars(12) (which are the step bars and their front smaller ends are threaded), thread one bar being fitted with a collar(3) and the other thread bar being fitted with a ring(4). The thread bars are locked by handles(5),(6) which have inside threads (52)(62) at each center portion as shown in FIG. 2.

Iron wire(2), is made thin and with adequate stiffness. Both ends of each wire have adequate curvature so that it conforms to the shape of the two step-like ends of bar(1) and further make adequate turns when it itself makes free movements. One end of each iron wire(2) goes through and buckles a respective thru-hole(41) of the ring(4) to form a pivotal retaining end, and the other end is a free end which is usually kept at the inner rim of the collar(3) and the handle(6). The collar(3) and the handle(6) each has a notch (31) or (61). When the collar(3) and the handle(6) turn to align these two notches(31) and (61) with the free end of the iron wire (2), the iron wire(2) can be pulled upward and released out of the slot(11) of the round bar(1). When it is intended to clip a newspaper onto bar(1), we first put the folding plate at the newspaper's(8) central blank space into the slot(11) of the round bar (1), and second, we push down the iron wire(2) to clip the newspaper(8), then, we push down the free end of the iron wire(2) into the notches(31) and (61) of the collar(3) and the handle(6), respectively. Then collar(3) and handle(6) are turned with respect to each other to grasp the free end of the iron wire(2) tightly thereby allowing several pages of newspaper(8) to be tightly clipped between the round bar(1) and the iron wire(2). If it is desired to clip many copies of newspaper onto the round bar(1), the abovementioned procedures can be repeated until a copy of newspaper is clipped into each slot(11), then, this simple and rapid operation is completed. The hole(41) diameter of the ring(4) is made to be a little larger than the diameter of the iron wire(2) so that the iron wire(2) can move to make the actions of pulling up and pushing down. After the newspaper is clipped, the thickness of the newspaper will force the iron wire(2) to be held tightly within the ring(4) so that the iron wire(2) does not sway and the newspaper will not be loose neither.

I claim:

1. A newspaper clip comprising:

a generally cylindrically shaped bar member having a central portion grooved with a plurality of longitudinal slots and first and second end portions at respective ends of said central portion each having a smaller diameter than said central portion;

a ring member having a central opening for engaging said first end portion and a plurality of holes about a circumferential portion thereof;

a plurality of iron wires each wire having a first retaining end and a second end for being passed through a respective hole in said ring member said first end forming a pivotal junction between said wire and said ring member;

a collar member having a central opening for engaging said second end portion of said bar member and having a notch in a circumferential portion thereof adapted to receive and retain said second end of each wire;

each iron wire being shaped such that when released at its second end from said collar member notch, it may pivot freely away from said bar and when retained within said notch it is held securely within its respective groove of said bar member, the wires being individually releasable from said collar notch permitting the insertion or removal of a newspaper intended to be held by any of said wires within its respective groove.

2. A newspaper clip according to claim 1 wherein both end portions of said bar member include a threaded portion adapted for attachment to a handle.

3. A newspaper clip according to claim 1 or 2 wherein said second end of said bar member is adapted to pass through said collar and then be locked by a handle attached to said second end.

4. A newspaper clip according to claim 3 wherein said collar includes a notched portion at an outer rim thereof.

5. A newspaper clip according to claim 1 further including a handled adapted to be threadably attached to an end portion of said bar member.

6. A newspaper clip according to claim 1 or 2 wherein said first end of said bar member is adapted to pass through said ring and then be locked by a handle attached thereto.

7. A newspaper clip according to claim 1 wherein the number of holes in said ring member correspond identically to to the number of grooves formed in said bar member with one hole corresponding to each of said grooves.

8. A newspaper clip according to claim 1 wherein said wires are generally U-shaped adapted generally to fit within a groove of said bar member and follow the longitudinal portion and end portions thereof.

* * * * *